US007274146B2

(12) United States Patent
Su

(10) Patent No.: US 7,274,146 B2
(45) Date of Patent: Sep. 25, 2007

(54) ELECTRODE STRUCTURE OF A PLASMA DISPLAY PANEL

(75) Inventor: Yao-Ching Su, Taoyuan (TW)

(73) Assignee: AU Optronics Corp., Hsinchu (TW)

( * ) Notice: Subject to any disclaimer, the term of this patent is extended or adjusted under 35 U.S.C. 154(b) by 251 days.

(21) Appl. No.: 11/053,470

(22) Filed: Feb. 8, 2005

(65) Prior Publication Data

US 2005/0194902 A1 Sep. 8, 2005

(30) Foreign Application Priority Data

Mar. 3, 2004 (TW) ..... 93105500 A

(51) Int. Cl.
*H01J 17/49* (2006.01)

(52) U.S. Cl. ..... 313/588; 313/582

(58) Field of Classification Search ..... 313/582–587; 345/60; 315/169.1, 169.3
See application file for complete search history.

(56) References Cited

U.S. PATENT DOCUMENTS

| | | | | |
|---|---|---|---|---|
| 6,333,599 | B1 | 12/2001 | Kawanami et al. | 313/582 |
| 6,376,986 | B1 | 4/2002 | Takagi et al. | 313/582 |
| 6,376,987 | B1 | 4/2002 | Amemiya et al. | 313/586 |
| 6,384,531 | B1 * | 5/2002 | Park et al. | 313/584 |
| 6,512,337 | B2 | 1/2003 | Hirano et al. | |
| 6,531,819 | B1 * | 3/2003 | Nakahara et al. | 313/584 |
| 6,630,790 | B2 * | 10/2003 | Kanazawa et al. | 313/584 |
| 2003/0076037 | A1 | 4/2003 | Choi | |

FOREIGN PATENT DOCUMENTS

| | | |
|---|---|---|
| CN | 1264914 A | 8/2000 |
| CN | 1407583 A | 4/2003 |
| JP | 2002324490 | 8/2002 |
| TW | 541564 | 4/2002 |

OTHER PUBLICATIONS

China Office Action dated Feb. 10, 2006.

* cited by examiner

*Primary Examiner*—Joseph Williams
(74) *Attorney, Agent, or Firm*—Thomas, Kayden, Horstemeyer & Risley

(57) ABSTRACT

An AC plasma display panel. A front substrate is opposite a rear substrate, and a plurality of ribs are interposed therebetween, defining a plurality of sub-pixels. The front substrate has a plurality of sustain electrodes extending along a first direction. Each of the sustain electrodes has a auxiliary electrode, a plurality of extending electrodes extending along a second direction and sticking into the corresponding sub-pixels, and a plurality of connecting electrodes, each of which connects adjacent extending electrodes.

14 Claims, 8 Drawing Sheets

ELECTRODE STRUCTURE OF A PLASMA DISPLAY PANEL

BACKGROUND

The present invention relates to plasma display and in particular to an AC plasma display panel.

A plasma display panel (PDP) is a thin type display, typically with a large viewing area. The luminescent principle of the PDP is the same as that of fluorescent lamps, wherein a vacuum space is filled with inert gas, and when a voltage is applied to the vacuum space, plasma is generated and radiates ultraviolet (UV) rays. The fluorescent material coated on the wall of the glass trough adsorbs the UV rays, hence the fluorescent material radiates visible light including red, green and blue light. A plasma display can be described as a combination of hundreds of thousands of illuminating units, each illuminating unit has three subunits for radiating red, green and blue light, respectively. Images are displayed by mixing these three primary colors.

As shown in FIG. 1, a conventional PDP 10 has a pair of glass substrates 12, and 14 arranged parallel and opposite to each other. A discharge space 16 between the glass substrates 12, and 14 is injected with inert gases, such as Ar, Xe or others. The upper glass substrate 12 has a plurality of transverse electrode groups positioned in parallel, each group of which has a first and a second sustaining electrode 18 and 20, each of which includes transparent electrodes 181 and 201 and auxiliary electrodes 182 and 202. A dielectric layer 24 further covers transverse electrodes, and a protection layer 26 covers the dielectric layer 24.

The lower glass substrate 14 has a plurality of barrier ribs 28, parallel and spaced by a predetermined distance dividing the discharge space 16 into a plurality of groups of sub-discharge spaces. Each group of sub-discharge spaces includes a red discharge space 16R, a green discharge space 16G, and a blue discharge space 16B. Additionally, the lower glass substrate 14 has a plurality of lengthwise electrodes 22 disposed parallel between two adjacent barrier ribs 28 serving as address electrodes. A red fluorescent layer 29R, a green fluorescent layer 29G, and a blue fluorescent layer 29B are respectively coated on the lower glass substrate 14 and the sidewalls of the barrier ribs 28 within each red discharge space 16R, each green discharge space 16G, and each blue discharge space 16B.

When voltage is applied to drive the electrodes, the inert gas in the discharge space 16 is discharged to produce UV rays. The UV rays further illuminate the fluorescent layers 29R, 29G, 29B to radiate visible light including red, green and blue light. After the three primary colors are mixed at different ratios, visible images are formed and transmitted through the upper glass substrate 12.

FIG. 2 is a local top view of FIG. 1. Referring to FIG. 2, the ribs 28 are arranged in parallel and spaced apart from each other on the rear substrate. In a discharge space 16 between the first sustain electrode 18 and the second sustain electrode 20, inert gas is ionized to strike the fluorescent layers on the rear substrate and the ribs 28 to generate light. However, only the fluorescent layers coated on adjacent ribs 28 can generate light, hence luminance of the PDP is not enough. Additionally, drawbacks of the open discharge space are that the adjacent discharge space 162 is prone to crosstalk, causing interference between cells and reducing the PDP 10 display quality.

U.S. Pat. No. 6,376,987 discloses a display panel comprising a pair of row electrodes extending in parallel in a first direction, a discharge gap formed between the pair of row electrodes, and a column electrode extending in a second direction. Each of the row electrodes comprises a first conductive layer having a body portion and a projecting portion. The projecting portion comprises an end portion, and extends from the body portion away from the discharge gap towards said end portion. If row electrodes are broken, point defects are generated and thus decrease the yield.

SUMMARY

Embodiments of the invention provide an AC plasma display panel. A front substrate is opposite a rear substrate. A plurality of ribs are interposed therebetween, defining a plurality of sub-pixels. The front substrate comprises a plurality of sustain electrodes, extending along a first direction, each comprising a auxiliary electrode, a plurality of extending electrodes extending from the auxiliary electrode and sticking into the corresponding sub-pixels, and a plurality of connecting electrodes, connecting adjacent extending electrodes.

BRIEF DESCRIPTION OF THE DRAWINGS

The present invention can be more fully understood by reading the subsequent detailed description and examples with references made to the accompanying drawings, wherein.

DETAILED DESCRIPTION

In embodiments of the invention, each of sustain electrodes structures comprises a conductive auxiliary electrode, transparent extending electrodes and connecting electrode, each of which connects two adjacent extending electrodes.

FIRST EMBODIMENT

Figure 1:
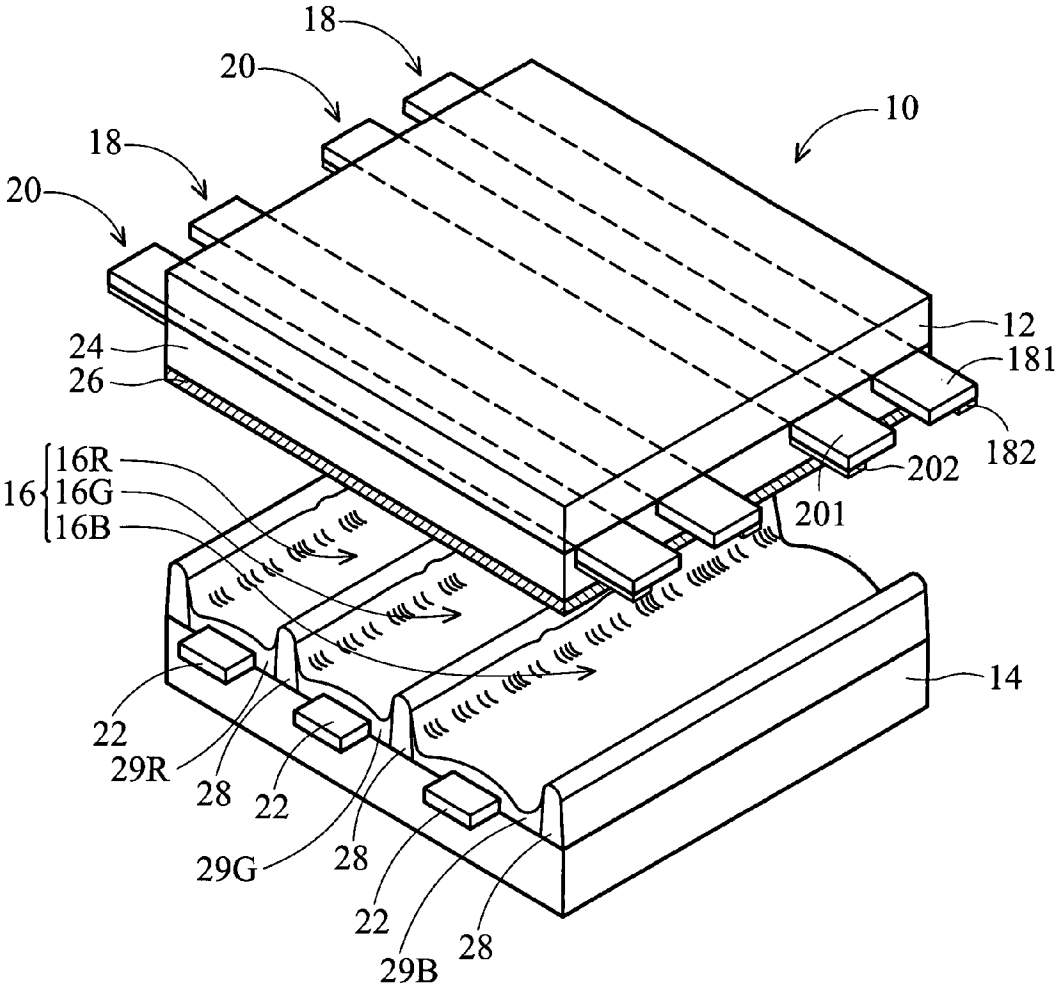
FIG. 1 (RELATED ART)
FIG. 1 shows the structure of a conventional PDP.
Figure 2:
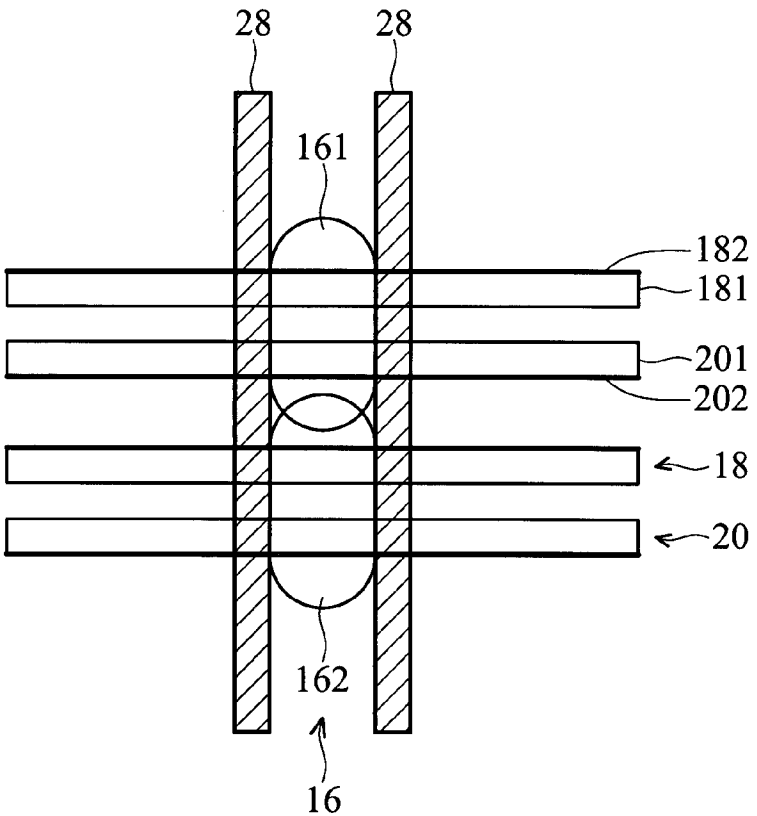
FIG. 2 (RELATED ART)
FIG. 2 is a plane view of the conventional PDP with enclosed discharge spaces.
Figure 3A:
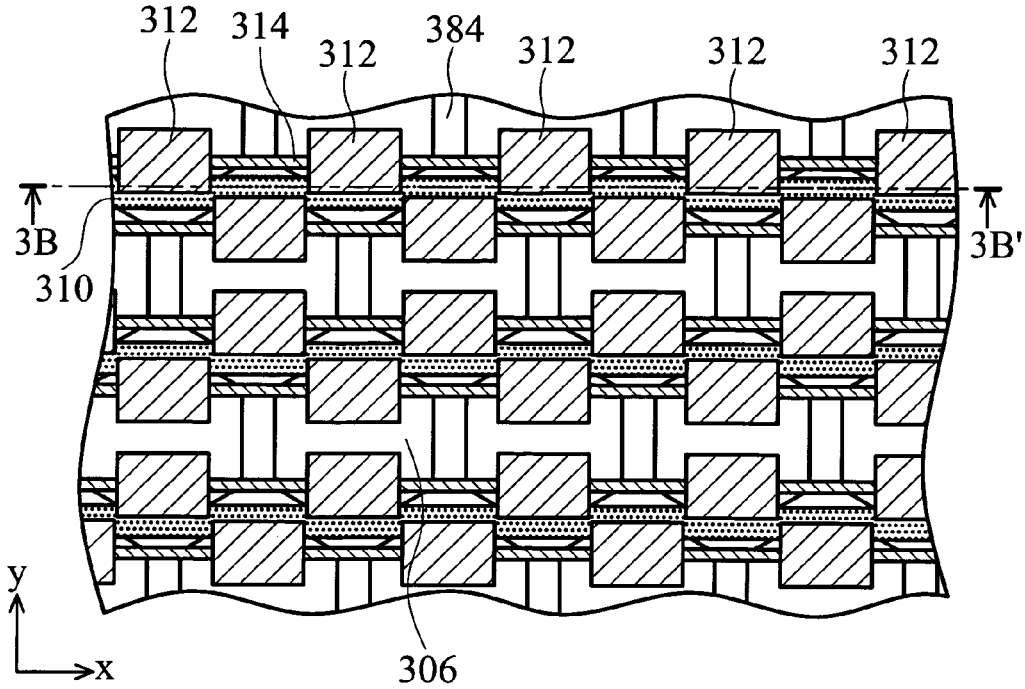
FIG. 3A is a top view of a PDP of a electrode structure of a first embodiment of the invention.
Figure 3B:
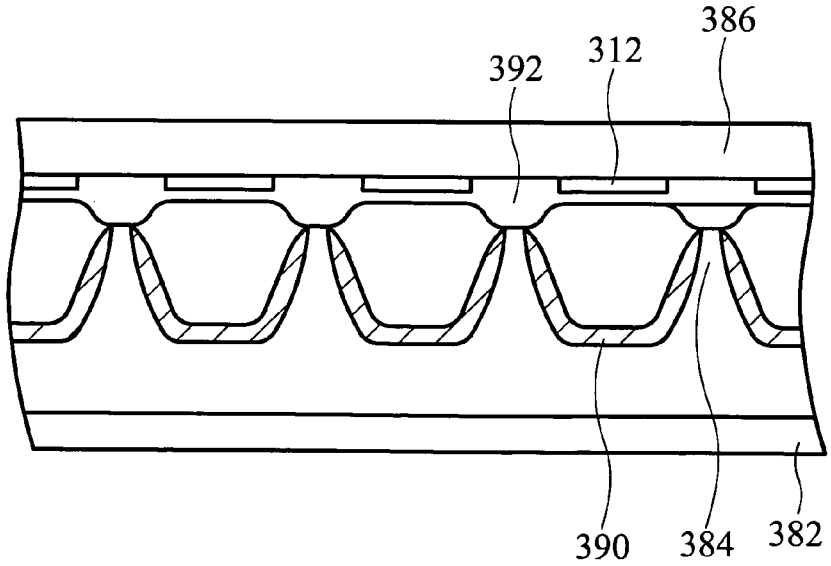
FIG. 3B is a cross section along line 3B-3B' of FIG. 3A.

FIG. 3A is a top view of a PDP structure of a first embodiment of the invention. FIG. 3B is a cross section along line 3B-3B' in FIG. 3A.

As shown in FIG. 3A and FIG. 3B, an AC PDP comprises a rear substrate 382 with ribs defining hexagonal sub-pixel spaces 306. Address electrodes (not shown) are formed under sub-pixel spaces 306, and red, green and blue phosphor layers 390 are respectively disposed on the hexagonal sub-pixel spaces 306 in a delta configuration, forming delta color pixels 306. Ribs 384 preferably have two layers with different color, the top layer is black to enhance contrast and the bottom layer is white to increase luminance. A preferable height of the ribs 384 is 100 μm~180 μm.

Referring to FIG. 3A and FIG. 3B, a front substrate 386 disposed over the rear substrate 382 comprises a plurality of parallel auxiliary electrodes 310 disposed on the front substrate 386, the auxiliary electrodes extending in direction X. A plurality of extending electrodes 312 extending in direction Y from the corresponding auxiliary electrodes 310 to stick into corresponding sub-pixels 306. The extending electrodes 312 can have any shape. The auxiliary electrodes 310 can be a multi-layer metal film, such as Cr/Cu/Cr, or Ag, and the extending electrodes 312 preferably comprise transparent conductive material, such as ITO.

The sustain electrode comprises the auxiliary electrode 310, a plurality of extending electrodes extending 312 from the auxiliary electrode 310, and at least one connecting electrode 314 connecting two adjacent extending electrodes 312. The connecting electrodes 314 are preferably transparent conductive materials, such as ITO, and have a thickness of 0.1 μm~45 μm. As illustrated in FIG. 3B, a fluorescent layer 390 is formed on the rib, and a dielectric layer 392 covers the auxiliary electrodes 312, the extending electrodes and the connecting electrodes (not shown in FIG. 3B).

Figure 4:
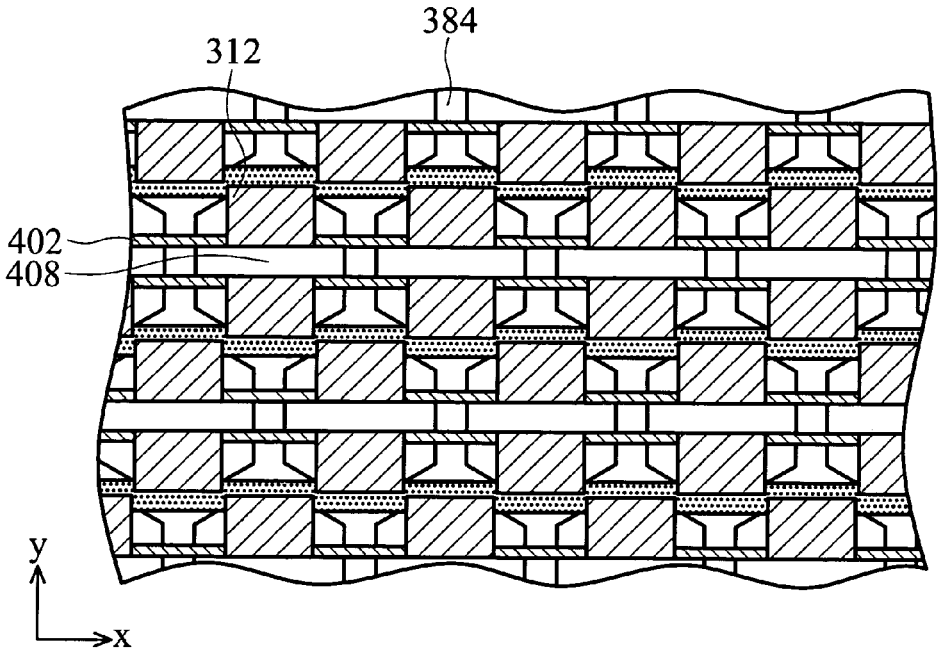
FIG. 4 is a top view of a PDP of another electrode structure of the first embodiment.
Figure 5:
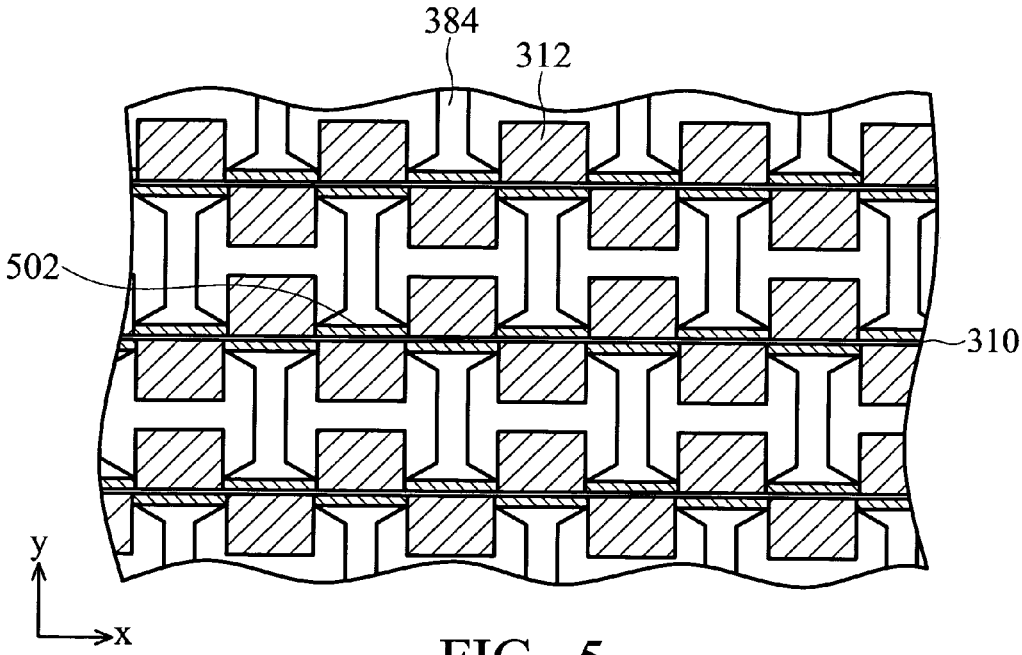
FIG. 5 is a top view of a PDP of further another electrode structure of the first embodiment.
Figure 6:
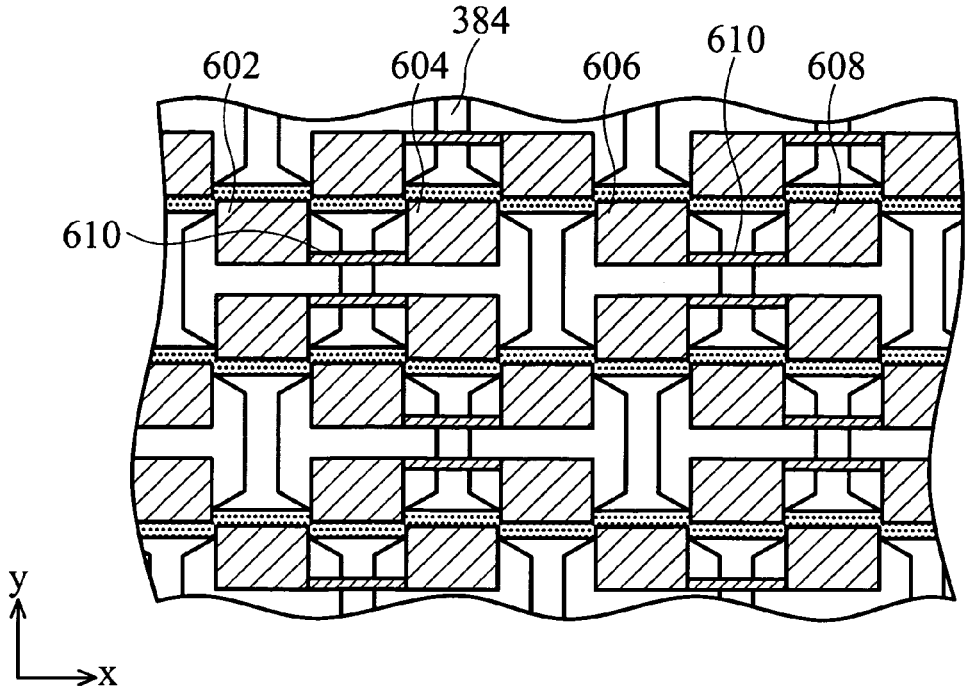
FIG. 6 is a top view of a PDP of yet another electrode structure of the first embodiment.

The connecting electrode 314 can connect two adjacent extending electrodes 312, belonging to a sustain electrode and extending along the same direction, at any position. Referring to FIG. 3A, one of the connecting electrodes 314 connects two adjacent extending electrodes 312 in the middle position. In FIG. 4, the connecting electrode 402 is close to a discharge gap 408 between two extending electrodes 312 in a sub-pixel. In FIG. 5, the connecting electrode 502 is adjacent to the auxiliary electrode 310. Referring to FIG. 6, the extending electrodes of a sustain electrode comprise first, second, third and fourth extending electrodes 602,604,606 and 608 extending in the same direction. First and second extending electrodes 602 and 604, and third and fourth extending electrodes 606 and 608 are electrically connected by connecting electrodes 610, with no connecting electrode connecting the second and third extending electrodes 604 and 606.

Figure 7:
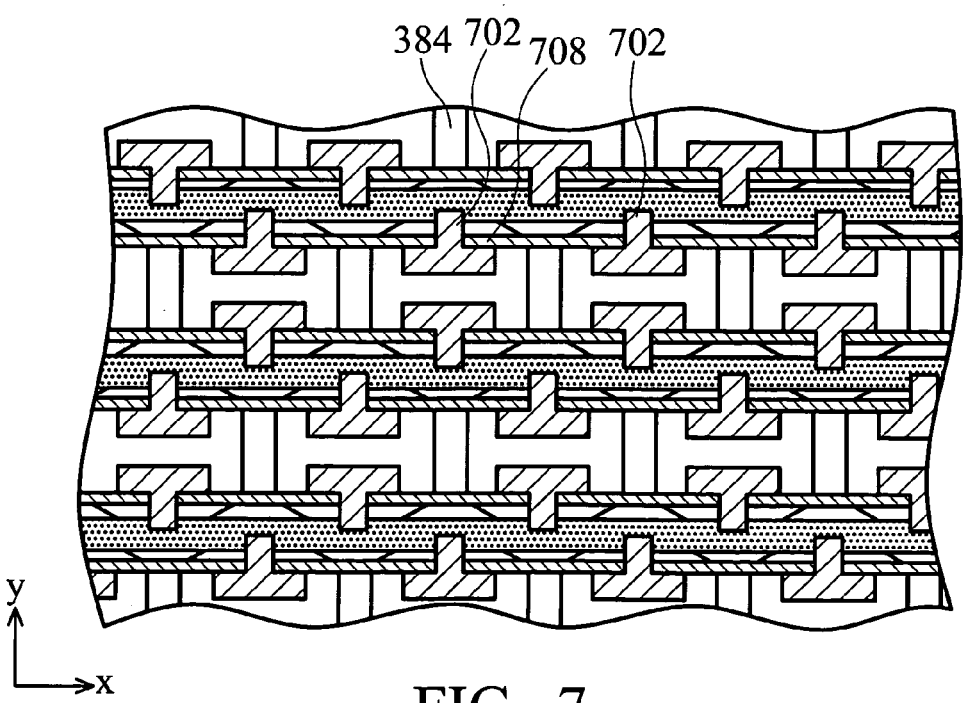
FIG. 7 is a top view of a PDP of yet further another electrode structure of the first embodiment.

The extending electrodes can be any shape, such as rectangle, round or T-shaped. In FIG. 7, the extending electrodes 702 are T-shaped, and two adjacent T-shaped extending electrodes 702 of a sustain electrode are electrically connected in the middle position by a connecting electrode 708.

Figure 8:
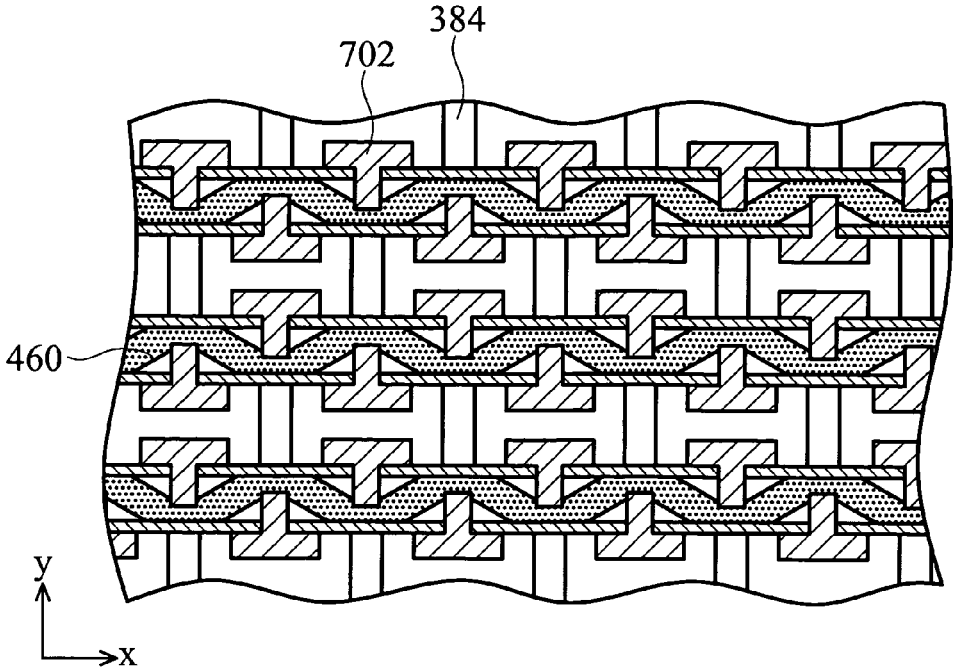
FIG. 8 is a top view of a PDP of additional electrode structure of the first embodiment.
Figure 9:
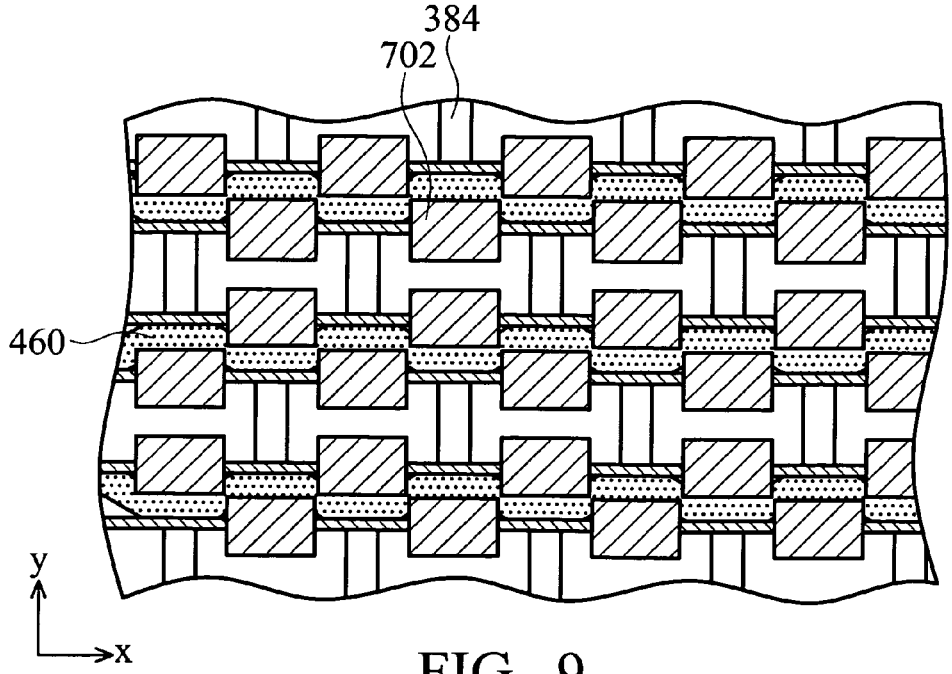
FIG. 9 is a top view of a PDP of further additional electrode structure of the first embodiment.

In FIG. 8, the auxiliary electrodes 460 are zigzag-shaped, extending along the zigzag-shaped row portions of the ribs, and in FIG. 9, rectangle.

SECOND EMBODIMENT

In this embodiment, the ribs, connecting electrodes and extending electrodes are the same as that in the first embodiment, only the auxiliary electrode structure differs.

Figure 10:
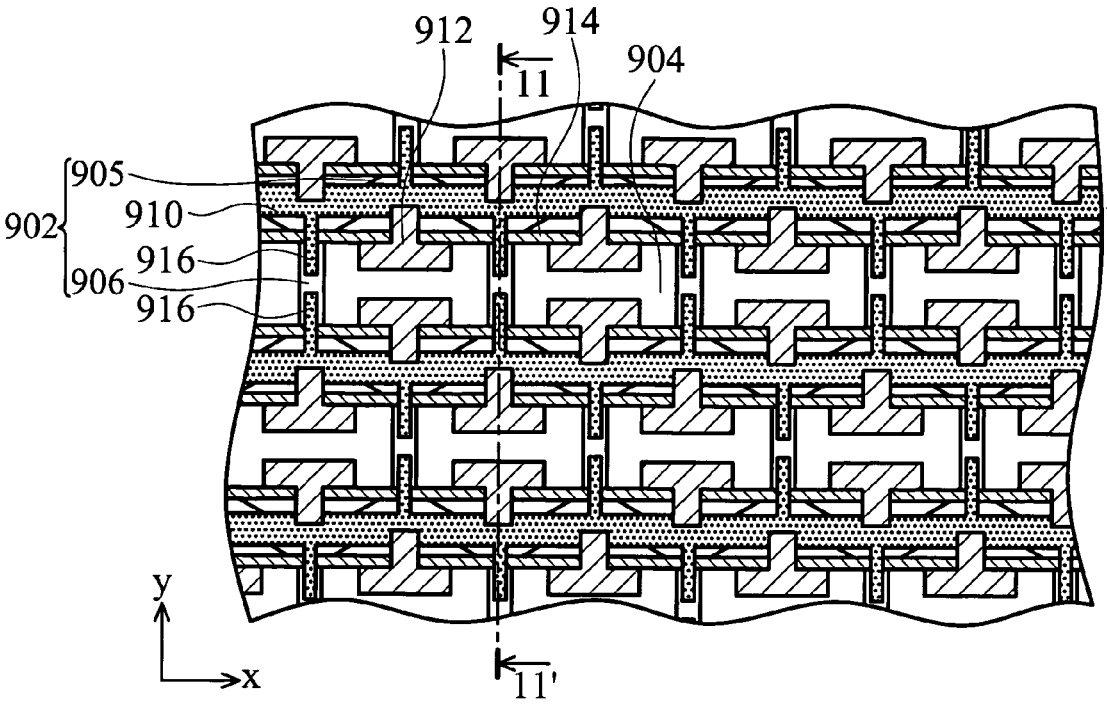
FIG. 10 is a top view of a PDP of an electrode structure of a second embodiment.
Figure 11:
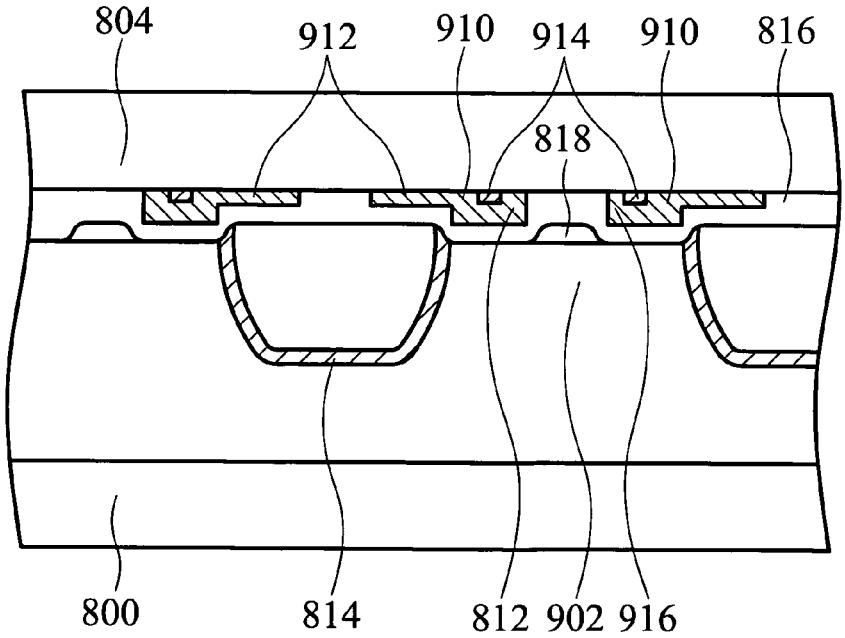
FIG. 11 is cross section along line 11-11' of FIG. 10.

FIG. 10 is a top view of a PDP structure of a second embodiment of the invention. FIG. 11 is a cross section along line 11-11' in FIG. 10.

As shown in FIG. 10 and FIG. 11, an AC PDP comprises a rear substrate 800 formed with ribs 902 defining hexagonal sub-pixel spaces 904. Address electrodes (not shown) are formed under sub-pixel spaces 904, and red, green and blue phosphor layers 814 respectively disposed on the hexagonal sub-pixel spaces in a delta configuration, creating delta color pixels 904. Ribs 902 comprise zigzag-shaped row ribs 905, substantially extending in the direction X, and column ribs 906 arranged in parallel to each other perpendicularly intersect with the row ribs 904, thereby defining sub-pixel spaces 908 in a delta configuration.

A front substrate 804 disposed over the rear substrate 800 comprises a plurality of parallel auxiliary electrodes 910 disposed on the front substrate 804 extending in the direction X. A plurality of T-shaped extending electrodes 912 extend in direction Y from the corresponding auxiliary electrodes 910, sticking into corresponding sub-pixels 908. While extending electrodes 912 are T-shaped in this embodiment, they can be any shape.

A sustain electrode comprises a auxiliary electrode 910, a plurality of extending electrodes 912 extending therefrom and a plurality of connecting electrodes 914, each of which connects two adjacent extending electrodes 912. In addition, one auxiliary electrode 910 further comprises a plurality of extending portions 916, extending along the column ribs 906.

As illustrated in FIG. 11, a fluorescent layer 814 is formed on the rib 902, and a dielectric layer 816 covers the auxiliary electrodes 910, the extending electrodes 912 and the connecting electrodes 914. When the dielectric layer 816 is formed covering the auxiliary electrodes 910 and extending electrodes 912, due to the topography, gaps 818 may be generated, thus eliminating crosstalk between two adjacent sub-pixels.

Figure 12:
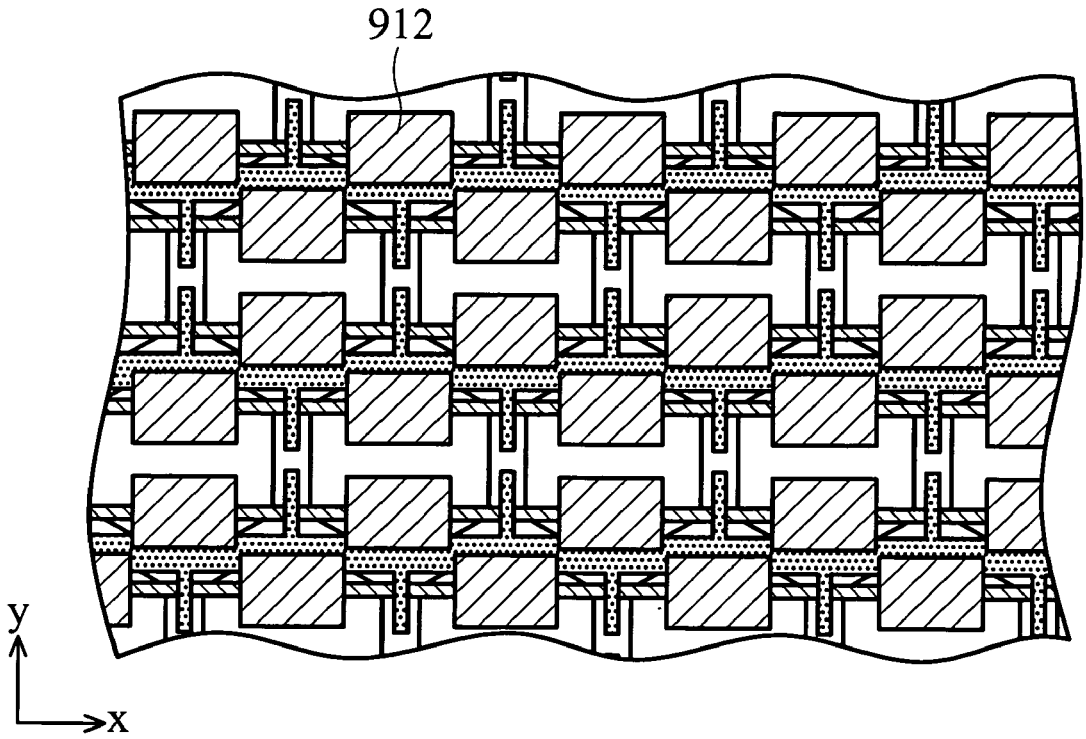
FIG. 12 is a top view of a PDP of another electrode structure of the second embodiment.

The extending electrodes 912 are T-shaped in FIG. 10, but can be any shape, for example rectangle as illustrated in FIG. 12.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An AC plasma display panel, comprising opposite front and rear substrates, a plurality of ribs interposed therebetween, defining a plurality of closed sub-pixels, wherein the front substrate comprises a plurality of sustain electrodes, extending along a first direction, each of the sustain electrodes comprises:

a auxiliary electrode;

a plurality of extending electrodes extending from the auxiliary and sticking into the corresponding sub-pixels; and a plurality of connecting electrodes, each of which connects two adjacent extending electrodes.

2. The AC plasma display panel as claimed in claim 1, wherein the width of the connecting electrodes is 0.1 μm~45 μm.

3. The AC plasma display panel as claimed in claim 1, wherein the auxiliary electrode is zigzag-shaped or a straight line.

4. The AC plasma display panel as claimed in claim 1, wherein the extending electrodes are rectangle or T-shaped.

5. The AC plasma display panel as claimed in claim 1, wherein the extending electrodes comprise first, second, third and fourth extending electrodes, the first and second extending electrodes, and the third and fourth extending electrodes electrically connected by at least one of the connecting electrodes, with no connecting electrode connecting the second and third extending electrodes.

6. The AC plasma display panel as claimed in claim 1, wherein the auxiliary electrodes comprises a plurality of extending portions extending in a second direction and along the corresponding ribs.

7. The AC plasma display panel as claimed in claim 6, wherein the first and second directions are perpendicular.

8. An AC plasma display panel, comprising:

opposite front and rear substrates;

a plurality of ribs interposed between the front and rear substrates, defining a plurality of closed sub-pixels in a delta configuration;

a plurality of sustain electrodes disposed on the inner side of the front substrate, extending along a first direction, each of the sustain electrodes comprises a auxiliary electrode, a plurality of extending electrodes extending along a second direction and sticking into the corresponding sub-pixels and a plurality of connecting electrodes, each of which connects two adjacent extending electrodes, the auxiliary electrodes comprising a plurality of extending portions extending along the corresponding ribs and in the second direction.

9. An AC plasma display panel as claimed in claim 8, wherein width of the connecting electrodes is 0.1 μm~45 μm.

10. The AC plasma display panel as claimed in claim 8, wherein the sub-pixels are polygons or circles.

11. The AC plasma display panel as claimed in claim 8, wherein the auxiliary electrode is zigzag-shaped or a straight line.

12. The AC plasma display panel as claimed in claim 8, wherein the extending electrodes are rectangle or T-shaped.

13. The AC plasma display panel as claimed in claim 8, wherein the extending electrodes comprise first, second, third and fourth extending electrodes, the first and second extending electrodes, and the third and fourth extending electrodes electrically connected by at least one of the connecting electrodes, with no connecting electrode connecting the second and third extending electrodes.

14. The AC plasma display panel as claimed in claim 8, wherein the first and second directions are perpendicular.

* * * * *